United States Patent [19]

Comer

[11] Patent Number: 4,942,965

[45] Date of Patent: Jul. 24, 1990

[54] ELONGATED TRAY FOR SUPPORTING TUBULAR OBJECTS

[76] Inventor: Robert E. Comer, 1228 42nd Ave., Greeley, Colo. 80634

[21] Appl. No.: 375,338

[22] Filed: Jul. 3, 1989

[51] Int. Cl.[5] ..... B65D 85/42

[52] U.S. Cl. ..... 206/419; 206/443; 206/585; 206/593

[58] Field of Search ..... 206/419, 418, 443, 585, 206/587, 591, 592, 593, 594; 217/27, 35; 220/23.6, 23.8

[56] References Cited

U.S. PATENT DOCUMENTS

| | | | |
|---|---|---|---|
| D. 202,580 | 12/1964 | Weiss | D58/13 |
| D. 249,638 | 9/1978 | Chadbourne | D9/189 |
| 1,347,909 | 7/1920 | Perris . | |
| 2,564,834 | 8/1951 | Devine et al. | 65/15 |
| 2,639,807 | 5/1953 | Ambrette et al. | 206/65 |
| 2,776,772 | 1/1957 | Itoda | 217/26.5 |
| 2,808,189 | 10/1957 | Williams | 229/14 |
| 2,815,856 | 12/1957 | Caswell | 206/65 |
| 3,018,015 | 1/1962 | Agriss et al. | 217/53 |
| 3,119,492 | 1/1964 | Burket | 206/62 |
| 3,120,901 | 2/1964 | Boyd | 217/26.5 |
| 3,143,274 | 8/1964 | Maize | 229/51 |
| 3,163,312 | 12/1964 | Chaplin | 217/26.5 |
| 3,195,770 | 7/1965 | Robertson | 220/23.5 |
| 3,219,232 | 11/1965 | Wilson | 220/97 |
| 3,223,234 | 12/1965 | Weiss | 206/65 |
| 3,282,458 | 11/1966 | Rudd | 217/26.5 |
| 3,379,340 | 4/1968 | Silvio | 220/97 |
| 3,398,840 | 8/1968 | Wilson | 211/126 |
| 3,497,102 | 2/1970 | Bessett et al. | 220/23.8 |
| 3,708,084 | 1/1973 | Bixler et al. | 217/26.5 |
| 3,771,646 | 11/1973 | Mascetti | 206/65 K |
| 3,777,885 | 12/1973 | Barteck | 206/72 |
| 3,786,932 | 1/1974 | Smith | 211/60 A |
| 3,926,305 | 12/1975 | Wallestad | 206/587 |
| 4,427,730 | 1/1984 | Robbins et al. | 428/156 |
| 4,491,225 | 1/1985 | Baillod | 206/585 |
| 4,705,170 | 11/1987 | Creaden | 206/419 |
| 4,792,045 | 12/1988 | Creaden | 206/419 |

*Primary Examiner*—David T. Fidei
*Assistant Examiner*—Jacob K. Ackun, Jr.
*Attorney, Agent, or Firm*—Norvell E. Von Behren

[57] ABSTRACT

An elongated tray designed to support a plurality of tubular objects such as fluorescent tubes when positioned in an outer package. The tray is formed with a plurality of cavities which have a plurality of tubular supporting surfaces contained therein. Each supporting surface is formed in a generally sinusoidal shape having a series of reversing curved configurations forming peaks and valleys. Each peak and valley contains approximate equal thickness material from the resilient type plastic used. As a result, controlled deformation with a controlled resilient return is obtained in the peaks and valleys to thereby result in a vastly superior tray which has improved resistance to breakage of the fluorescent tubes. The resilient plastic may be an HDPE or PP having a density ranging between 0.898–0.965 grams per cubic centimeter.

27 Claims, 3 Drawing Sheets

ELONGATED TRAY FOR SUPPORTING TUBULAR OBJECTS

BACKGROUND OF THE INVENTION

This invention relates generally to a supporting tray for tubular objects and more particularly to a new and novel thermoformed plastic tray that may be used to support fluorescent tubes in an outer corrugated package to minimize tube breakage whenever the outer package is accidentally dropped or handled roughly.

It is common in the industry to package fluorescent lamps in an outer box with a series of inner separations or trays between the lamps to prevent breakage in transit.

Prior to the early 1960's, a common material used for the separating tray was pulp paper as shown in the U.S. Pat. No. 3,143,274, issued Aug. 4, 1964 to Donald G. Maize and assigned to General Electric Company. Various configurations of formed pulp trays were designed thereafter as typified by the U.S. Pat. No. 3,163,312, issued Dec. 29, 1964 to Charles J. Chaplin and assigned to Diamond National Corporation. The pulp trays all tried to minimize tube breakage during handling and shipment of the package containing the fluorescent tubes to the ultimate customer.

With the advent of plastic technology and specialized plastics and forming techniques for those plastics, there were designed fluorescent separation trays to be formed out of plastic. For example the U.S. Design Pat. No. D-202,580 to Hugh R. Weiss and the U.S. Pat. No. 3,223,234, issued on Dec. 14, 1965 to the same inventor typified the use of a plastic tray formed from vacuum molded thin sheets of plastic. These designs and others to follow generally used parallel spaced apart ribs formed in side by side openings to support the fluorescent tubes. The rib supports were generally designed in a semicircular form and ran transverse to the longitudinal direction of the fluorescent tube.

Variations of this type of parallel rib supports can also be seen in the U.S. Pat. No. 3,708,084, issued Jan. 2, 1973, to Kenneth D. Bixler et al and in the U.S. Design Pat. No. D-249,638, issued Sept. 26, 1987 to Gilbert R. Chadbourne.

A variation of this standard type of rib support is shown in the U.S. Pat. No. 4,427,730, issued on Jan. 24, 1984, to Gerald L. Robbins et al and assigned to Keyes Fibre Company. This design was to be used either with molded pulp or foam plastic.

It is known to manufacture one-piece plastic trays out of polyvinyl chloride (PVC) as taught in the U.S. Pat. No. 4,705,170, issued to David E. Creaden on Nov. 10, 1987 and assigned to the Lawrence Paper Company of Lawrence, Kans. Reference should be made to that patent and the patents cited therein for a more detailed discussion of the overall problems encountered in protective packaging in general and in fluorescent tube tray design in particular.

The Creaden patent, while directed primarily to providing de-nesting features to make the tray more adaptable to machine facilities, primarily uses a dense polyvinyl chloride sheet material in the formation of the tray. In addition, the Creaden patent teaches the use of striations on the faces of the fluorescent tube engaging surfaces to obtain the necessary cushioning of the tube. The patent teaches also that the use of cushioning ribs on the tray's underside results in a controlled collapse of the respective elements of the tray. This feature of a controlled collapse is also claimed for certain notches in the tray and is believed to be responsible for the test results obtained by the patentee. In other words, the polyvinyl chloride tray uses a controlled collapse in certain parts of the tray which protects the tubes only on the first impact of a drop of the package. Subsequent impacts can not be protected since the tray does not permit the collapsed portions to spring back or return to their original positions. This is caused partly by the use of polyvinyl chloride (PVC) in the tray, which is a dense material, and partly by design imperfections which will be explained more fully hereinafter.

While prior art type trays were previously made of molded pulp or paperboard, the Creaden invention claims only to be able to equal the support performance of the seriously deficient molded pulp tray. It would be very advantageous to be able to provide far better support performance in a fluorescent tube tray than that obtainable by the Creaden invention. By his own admission in the patent, Creaden claims his tray is only as good as molded pulp trays. To be able to obtain a 30%–50% better performance of a tray in drop tests would appear to be highly supportive of the conclusion that such an improved tray had unique features and was certainly new and novel within the structure of the patent laws.

While the problems of the prior art trays have been only briefly discussed in this section, there will be discussed in greater detail hereinafter how the use of polyvinyl chloride and the particular design of the Creaden tray prevents a better performance. This will be discussed when showing the much improved tray of the applicant's design which, by actual test results, was able to obtain 30%–50% better performance in drop tests.

SUMMARY OF THE INVENTION

In order to overcome the poor performance obtained using a formed polyvinyl chloride (PVC) tray of the Creaden design there is provided by the applicant's design a unique type tray that does not use controlled crush features such as striations or crushing ribs in combination with PVC materials. The applicant's design in distinction uses a totally new approach of a controlled deformation with a controlled resilient return from the deformation of the parts of the tray after a load is applied.

In other words the applicant's unique tray parts do not crush and remain crushed but deform and spring back after removal of a crushing load. After impact from dropping, the formations in the applicant's tray return to their originally formed shape, a function similar to that of a rubber tire as it reacts to the impacts of a bumpy road.

The applicant's unique design introduces the new concept of protection to fragile products, such as fluorescent tubes, in that the shapes of supporting ribs, platforms and walls that separate the articles are so designed as to effectively accept minimum shock and then to spring back to their original form after impact. To accomplish this, the functional design includes the correct combination of supporting rib height, width and draft with proper spacing between each supporting formation which is necessary to advantageously distribute the plastic material substantially equally at the points of contact of each lamp surface. This unique feature will be discussed more fully hereinafter when referring to the Description of the Preferred Embodiment.

The novel tray of this invention provides a plurality of side by side receiving cavities which have formed therein a plurality of tubular supporting surfaces which are formed in a generally sinusoidal shape having a series of reversing curved configurations forming peaks and valleys. The unique tray is formed of a plastic material having a density ranging between 0.898–0.965 grams per cubic centimeter (g/cc). In the preferred embodiment hereinafter to be described, a high density polyethylene or a polypropylene random copolymer may be used. These materials have the necessary resilience to spring back as opposed to the more dense and rigid prior art materials of polyvinyl chloride (PVC) used in the Creaden device and other prior art types.

In designing the applicant's unique tray, the thickness of the plastic material used is formed in the peaks and valleys in an approximate equal thickness so that the material forming the tray will have a controlled deformation with a controlled resilient return from the deformation upon a load shock being applied to and removed from the peaks and valleys.

The uniquely shaped tubular supporting surfaces are formed in generally V-shaped configurations running diagonally and not transversely parallel as is common in the prior art. The diagonal V-shaped supporting surfaces form two X-shaped configurations when looking down on the unique tray. The particular design of the preferred embodiment will be discussed hereinafter in more detail and in particular how the applicant's novel design permits the supporting surfaces and platforms along with their cavities to act independently from each other so as to float during load shock and to provide a staggered resistance to load shock.

In addition there will be described in detail hereinafter how it is believed that the applicant's unique design of longitudinal spacer walls between adjacent receiving cavities are formed so as to transfer load shock from one cavity to the adjacent cavity. The unique design of the longitudinal spacer walls also contains new and novel features that provide much improved product separation between adjacent fluorescent tubes which contributes also to the 30%–50% improvement in breakage during drop tests.

An improved de-nesting feature is employed in the applicant's unique tray to overcome the problems encountered in the Creaden design.

Accordingly it is an object and advantage of the present invention to provide a much improved fluorescent tube support that utilizes a controlled deformation with a controlled resilient return after deformation of portions of the tray in a manner similar to that of an automobile tires' action.

Another object and advantage of the subject invention is to provide a unique support tray that is more resilient by using a material having a density ranging between 0.898 and 0.965 grams per cubic centimeter (g/cc).

A further object and advantage of the applicant's unique invention is to provide a support tray having various design features which permit parts of the tray to float in regard to other portions and to provide staggered resistance to load shock with the load also being capable of being transferred to an adjacent portion of the tray.

These and other unique objects and advantages will become apparent from a review of the drawings and from a detailed reading of the Description of the Preferred Embodiment hereinafter which has been given by way of illustration only.

DESCRIPTION OF THE PREFERRED EMBODIMENT

Figure 1:
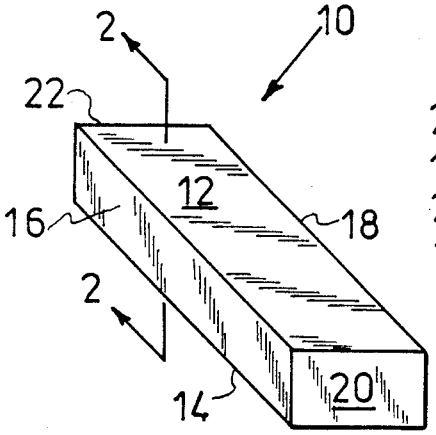
FIG. 1 is a perspective view of a corrugated package containing a plurality of fluorescent tubes held in place by the applicant's novel supporting trays.

Referring now to the drawings in general and in particular to FIG. 1 of the drawings, there is shown generally by the numeral 10 one type of a corrugated package into which is placed the applicant's supporting trays along with a plurality of fluorescent tubes. The package 10 is generally formed of corrugated paperboard with a top 12 and a bottom 14 having connecting sides 16 and 18. A second bottom 30 is integrally formed with the side 18 as shown in FIG. 2, and a pair of end flaps 20 and 22 are used to enclose the entire contents of the package.

Figure 2:
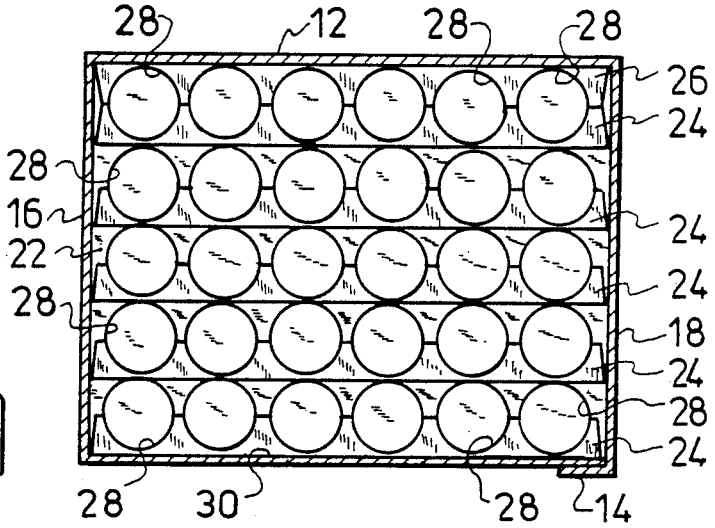
FIG. 2 is a cross-sectional view, taken along lines 2—2 of FIG. 1 showing the trays and tubes positioned inside the package.

Referring now to FIG. 2, there is shown a cross-sectional view, taken along lines 2—2 of FIG. 1. A plurality of elongated supporting trays 24 are used in a stacked configuration to hold the fluorescent tubes 28 tightly to prevent them from breaking during transit or handling of the package. In the container shown in FIG. 2, five trays 24 would be stacked on top of each other with an inverted tray 26 being used on the top row. The applicant's unique tray is designed so the bottom of the tray contains supporting surfaces also for the fluorescent tube below, which will be described in more detail hereinafter when referring to FIGS. 4, 8, 12, 18 and 19.

Figure 3:
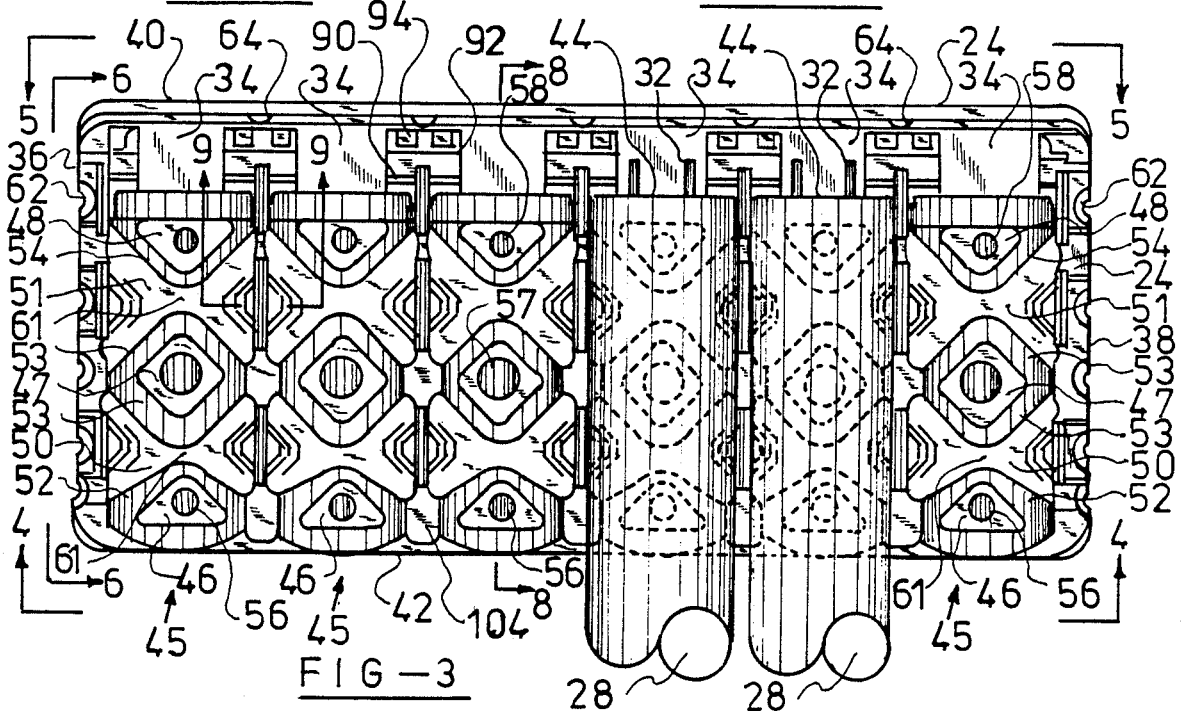
FIG. 3 is a top plan view of one of the fluorescent tube trays showing the applicant's unique design and showing two fluorescent tubes positioned in the supporting tray.

Referring now to FIG. 3 of the drawings there is shown a top plan view of one of the applicant's unique supporting trays and showing two fluorescent tubes 28 positioned in the novel tray 24. When discussing the features of the applicant's tray 24 in FIG. 3, the unique structural features will be primarily discussed. The materials used to form the tray will be detailed hereinafter when referring to FIGS. 13–19 and how the tray is believed to function to be able to perform with 30%–50% less tube breakage in the drop tests.

The applicant's elongated supporting tray 24 is designed to support a plurality of tubular objects such as fluorescent tubes 28 having end caps each containing two electrical pins 32 protruding from each end of the tube. In the embodiment shown, six (6) tubes are supported in the tray in a first plurality of tubular concaved shaped receiving cavities or cells shown generally at 45, which are formed integrally with a pair of side panels 36 and 38 and a low end panel 42 and a high end panel 40.

The high end panel 40 also contains a series of flat surfaces 34 over which the electrical pins 32 are positioned. In the package 10 shown in FIG. 1 and FIG. 2, six (6) trays of the applicant's design would be used in each end of the package to support the thirty (30) fluorescent tubes. Other trays would also be designed similar to the tray of FIG. 3 to support a greater number or lesser number of tubes and the applicant's invention is not to be limited to only a tray of six (6) cells 45 as shown in FIG. 3.

The end 44 of the fluorescent tube will abut the side of the flat surface 34 to hold the tubes from longitudinal movement in the package 10. Each of the first tubular concaved shaped receiving cavities or cells 45 would be formed with a plurality of cavities and ridges to form the supporting surfaces for the tubes 28 above and below each other.

It can be seen how a plurality of upwardly opening triangular shaped longitudinal cavities 46 and 48 are formed on the ends of each cell 45 and have a single upwardly opening diamond shaped longitudinal cavity 47 formed between them. Each cell 45 also has formed a pair of X-shaped upwardly opening transverse cavities 50 and 51. The triangular shaped cavities 46 and 48 as well as the diamond shaped cavity 47 are separated by the X-shaped cavities 50 and 51.

A series of downwardly opening longitudinal and transverse cavities are formed integrally with the upwardly opening cavities 46, 47, 48 and 50 and 51 and serve to separate these cavities from each other and to form supporting ridges or platforms that are used to support the fluorescent tubes 28. For example a generally V-shaped ridge or platform 52 is formed between the cavity 46 and the cavity 50 while a generally V-shaped ridge 54 is formed between the cavity 48 and the cavity 51. In a similar manner, a generally diamond shaped ridge or platform 53 is formed between the X-shaped central cavity 47 and the surrounding X-shaped cavities 50 and 51.

The downwardly opening cavities formed by the ridges or platforms 52, 53 and 54 form a generally elliptical supporting surface on spaced apart ridges when viewed from a diagonal between the longitudinal direction of the tube 28 and the transverse of the tube. They also form semicircular supporting ridges when looking from the transverse direction of the tube 28.

To enhance the support of the tube 28 a series of downwardly opening centrally positioned cavities 56, 57 and 58 are positioned in the cavities 46, 47 and 48. These cavities 56, 57 and 58 are formed with a semicircular top surface to conform to the semicircular shape of the tube in the transverse direction.

The ribs or platforms 52, 53 and 54 are separated by spanning cavities 61 formed out of the X-shaped cavities 50 and 51 at the center thereof. The spanning cavities or areas 61 forming the center of the X shaped cavities 50 and 51 allow each of the three tube supports 52, 53 and 54 to "float" somewhat independently of each other during load shock. It is believed that this slight difference in resistance between tube supports, with split-second differences in time because of this "float," results in a more favorable performance of the tray than compared to a simultaneous resistance which would be applied to the tube without this separation in the areas 61. The difference in resistance is called a staggered resistance in this description of the preferred embodiment.

In addition the three (3) semicircular top surfaces of the supporting posts, formed by the downwardly opening cavities 56, 57 and 58, are designed to add a further dimension of staggered resistance during impact whenever the package containing the tubes 28 is dropped or mishandled. These three (3) circular post tops, seen in FIG. 3 in each cell 45, are concaved as before described to conform to the circumference of the tube 28 as do all the configurations contained in the cells 45. These configurations diverge upwardly, semi-cylindrically to define the applicant's separating and partially encapsulating walls which will be described more fully when referring to FIGS. 9 and 10.

Figure 4:
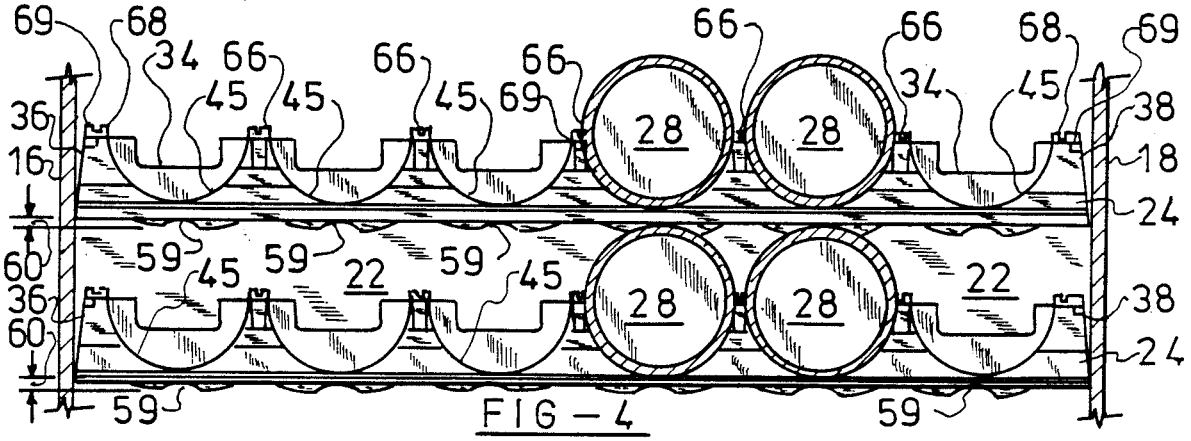
FIG. 4 is an end elevational view, taken along lines 4—4 of FIG. 3, shown partly in cross section and showing how several supporting trays are positioned on top of each other with the bottom portion of the trays being used to support the tubes below from movement in transit.
Figure 5:
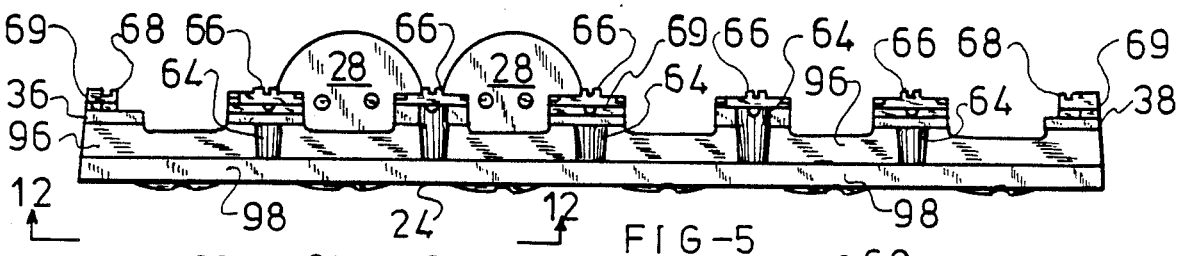
FIG. 5 is an end elevational view, taken along lines 5—5 of FIG. 3 showing in detail various structural features of the applicant's supporting tray.

Referring now to FIGS. 4 and 5 there will be described in more detail other features of the applicant's unique tray. FIG. 4 is an end elevational view, taken along lines 4—4 of FIG. 3 and shows in more detail how the formation of the particular cavities is used to support the adjacent tube 28 below an upper tube 28. The under surface of the tray 24 is formed with a series of second plurality of tubular concaved shaped receiving cavities 59 which extend below the bottom of the tray by a small distance shown by the arrow 60 in FIGS. 4 and 8. In FIG. 4 there are shown two (2) trays 24 positioned on top of each other and the extension of the second plurality of tubular concaved shaped receiving cavities 59 can be seen. For purposes of clarity, only four (4) tubes 28 have been shown and FIG. 4 shows how the extension 60 of the cavities 59 functions to tightly hold the adjacent tube in the tray.

There will be described more fully hereinafter, when referring to FIG. 12 of the drawings, each of the second plurality of cavities forming the second cavities 59 and in particular how these cavities function with a controlled deformation and controlled resilient return and are not crushed as is accomplished in prior art trays. Other features of the applicant's that add to its structural integrity can be seen in FIGS. 3–6. For example, the side panels 36 and 38 have formed therein a series of inclined strengthening ribs 62 while the high end panel 40 has a series of similar inclined strengthening ribs 64 formed therein. A series of formations for increasing the structural integrity of the tray by bracing can be seen at 90, 92 and 94 in FIG. 3 and skirt formations have been used to accomplish rigidity in the direction of the formation. These can be seen at 96 and 98 in FIG. 5 as well as in other portions of the tray which can clearly be seen.

Longitudinal spacer walls 66 have been used to separate interior adjacent fluorescent tubes 28 as can best be seen in FIGS. 4 and 5 and longitudinal spacer walls 68 have been used on each side of the tray. The design of the longitudinal spacer walls 66 and 68 forms a novel solution to separation wall construction and one which it is believed also contributes to the unique overall tray of the applicant. This novel design will be described in detail hereinafter when referring to FIGS. 9 and 10 of the drawings.

Figure 6:
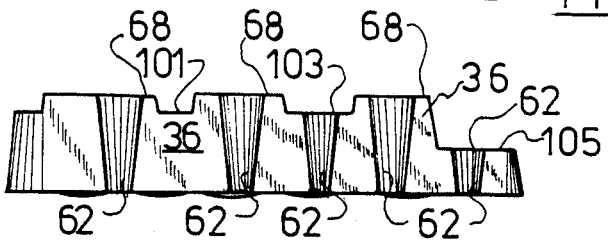
FIG. 6 is a side elevational view, taken along lines 6—6 of FIG. 3.

The longitudinal spacer walls 68 formed in the side walls 36 and 38 of the tray are formed in three separate sections separated by the indentation surface or notches 101, 103, and 105 as can be seen in FIG. 6 of the drawings. In a similar manner the longitudinal spacer walls 66, separating the inner cells or cavities 45, are formed in three similar separate sections separated by the surfaces or notches 100, 102, and 104 which can best be seen in FIG. 8 of the drawings.

Figure 8:
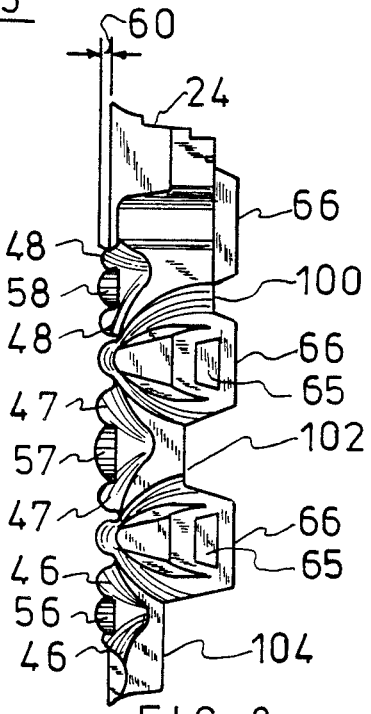
FIG. 8 is a single line cross-sectional view, taken along lines 8—8 of FIG. 3 showing in more detail the novel construction of the supporting tray.

The notches 100, 102, and 104 in the longitudinal spacer walls 66 formed at different heights, as can be seen in FIG. 8, are believed to present a "graduated" resistance to severe side impacts on the tray caused by dropping or mishandling. This "graduated" resistance in combination with the before described "staggered" resistance also is believed to contribute to the applicant's improved performance of his tray 24. To further enhance the applicant's improved tray with its protective separation features, there is formed a trapesoidal indented formation 65 in each side of the longitudinal spacer walls 66 which can also best be seen in FIG. 8 of the drawings. These indented formations 65 are positioned directly opposite each other on the spacer walls 66 and are designed to make contact with each other to serve as absorption bumper standoffs within the space between the adjacent tubular receiving cavities or cells 45 as a horizontal impact occurs. Horizontal shock is believed to be thereby absorbed between adjacent cells 45.

Figure 7:
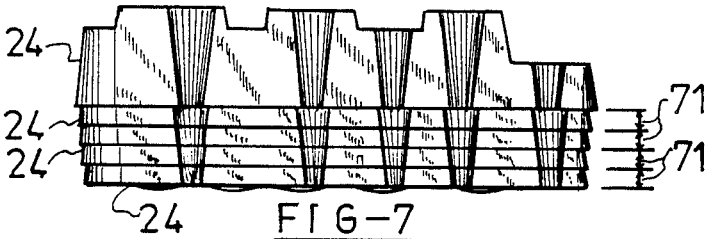
FIG. 7 is a side elevational view, similar to the view of FIG. 6, showing several supporting trays positioned together but spaced apart by novel spacer means to be described hereinafter when referring to FIG. 11 of the drawings.

There will now be described the applicant's novel approach to providing separation between adjacent trays 24 whenever they are stacked in a packaging machine. In order to best operate, the trays 24 should be spaced approximately 0.14 inches apart so that the tray can be dispensed from its stack in the packaging process by the tray machinery used. Referring to FIG. 7 there is shown a side elevational view similar to the view shown in FIG. 6 wherein five trays 24 are shown stacked on top of each other at the desired spacing shown by the arrow 71. In prior art trays of the type shown in the Creaden U.S. Pat. No. 4,705,170, a series of "nibs" and other formed configurations were used which required that each formed part be collated to assure that each tray in a stack was never matched with another tray of similar "nib" positioning.

This complicated design required up to 5–6 different stack configurations be used which then required up to 5–6 different tray molds be used. Of the 24 molds, there are at least four trays in every sheet that are alike with the Creaden design. With this nightmare of keeping the trays and molds separate, great care is needed to keep them separate during the forming and trimming procedure. This design can then be very troublesome all along the process from the formation in the mold to the customer's use in his plant. While the "uniqueness" of this feature is described in great detail in the Creaden patent, it is believed that in practice, the Creaden design causes more problems than it solves.

In distinction, the applicant's unique design of a de-nesting feature provides a plurality of simple de-nesting lugs 69 which serve as spacer means to prevent the complete nesting of similar trays when stacked on top of each other. The de-nesting lugs 69 are formed in the low end panel 42 and in the high end panel 40 as can be seen in FIGS. 4 and 5. Three de-nesting lugs 69 are formed in the low end panel 42 and three de-nesting lugs 69 are formed in the high end panel.

Figure 11:
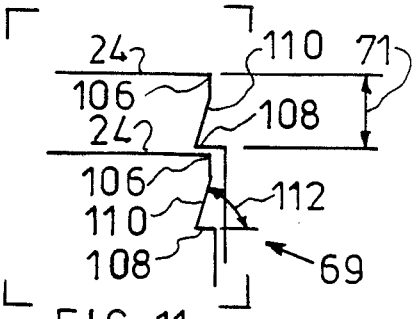
FIG. 11 is a single line pictorial representation of the construction of the applicant's unique spacer means or de-nesting lug used to provide tray separation of adjacent trays in order to ensure that the trays will properly pass through the packaging machine used in packaging of the fluorescent tubes.

By referring also to FIG. 11 of the drawing there can be seen the simple but unique construction of the de-nesting lug 69. FIG. 11 is a single line pictorial representation of two trays stacked on top of each other as shown in the bracketed area. It is known that any tray formed from a heated sheet of plastic material has a natural characteristic to nest tightly together with a similar tray when positioned one on top of the other. The purpose of a de-nesting lug is to assure a desired separation in a stacked position as shown in FIG. 7. By maintaining a consistent spacing 71 between adjacent trays 24, an unretarded departure of each tray from the stack is obtained as required by the automatic tray dispensing equipment.

While the separation distance 71 is arbitrary, depending on the requirements of the dispensing machine, it has been found in the applicant's use that a distance of 0.14 inches would be desirable. The de-nesting lug used in the applicant's tray comprises a downwardly turned corner 106 and an outwardly turned ledge 108 joined by a downwardly inclined or angled recess 110 which is formed at a 15° angle 112 in the vertical sidewalls of the tray at the positions hereinbefore described. When formed thusly, the ledge 108 is created which serves as an underneath support to each successive tray even though all trays can be made from the same mold. As a result, the applicant's de-nesting lug 69 can achieve the desired separation at 71 without the complicated structure and series of molds needed by the Creaden design.

Figure 9:
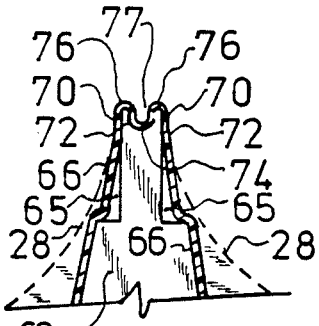
FIG. 9 is an enlarged cross-sectional view, taken along lines 9—9 of FIG. 3, showing in greater detail the novel longitudinal spacer wall construction designed to provide improved wall separation between adjacent fluorescent tubes.
Figure 10:
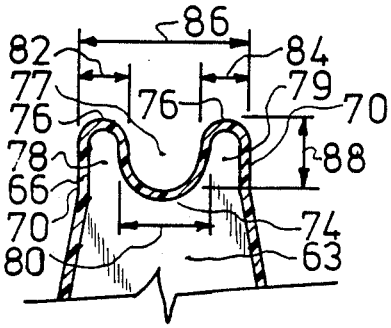
FIG. 10 is a further enlarged cross-sectional view, similar to the view of FIG. 9.

Referring now to FIGS. 9 and 10 there will be described the unique construction of the longitudinal spacer walls 66 and 68. FIG. 9 is an enlarged cross-sectional view, taken along lines 9—9 of FIG. 3 showing the spacer wall construction designed to provide improved wall separation between adjacent fluorescent tubes. FIG. 10 is a further enlarged view, similar to FIG. 9 and shows further details of the novel construction.

All prior art separating wall structures generally use a wall of separation formed over a separating rib with a flat top surface. When constructed thusly, a carton dropped horizontally will have the separating rib crushed since there is usually only a mere 0.010"–0.0125" of plastic formed in only two vertical walls separating adjacent lamp surfaces. In distinction, the applicant's unique design uses four walls of separation between adjacent tubes with three air spaces in between to provide an improved cushioning effect.

This can be seen in FIG. 9 where a pair of outer walls 70 and a pair of inner walls 72 are joined by a bottom wall 74 and two top walls 76. Three cushioning spaces 77, 78 and 79 are thereby formed in between the respective walls. When formed thusly, a 0.06 inch separation is provided in the center as shown by the arrow dimension 80 and two 0.05 inch separations 78 and 79 are formed on each side of the center as shown by the arrow dimensions 82 and 84. The resilient separation between adjacent tube surfaces will be at least 0.14 inches as shown by the arrow dimension 86. The inner cushioning space 77 would extend a distance of 0.06 inches deep as shown by the arrow dimension 88.

From this it can be seen how the applicant's four wall construction is able to provide at least 0.040"–0.050" of plastic with three cushioning areas between. In distinction, prior art separation of the type before described generally uses only 0.02–0.024 inches of a more or less hard, dense plastic construction using polyvinyl chloride (PVC). This PVC material is much more dense and less pliable than the type used in the applicant's design.

FIG. 9 also shows in some detail the indented trapesoidal shaped formations 65 and how they extend into the space 63 beneath the bottom wall surface 74 to act as the before described absorption bumpers. FIG. 9 also shows in dashed lines the outline of the adjacent fluorescent tubes 28 and how they are protected by the four wall/three cushioned area forming the separating spacer walls 66 and by a partial encapsulation.

Figure 12:
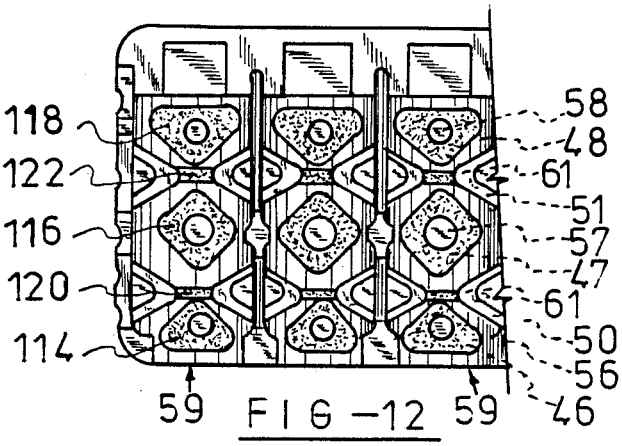
FIG. 12 is a partial bottom plan view, taken along lines 12—12 of FIG. 5, showing in greater detail the bottom structure of the applicant's supporting tray.

Referring now to FIG. 8 and to FIG. 12 there is shown in FIG. 12 a partial bottom plan view, taken along lines 12—12 of FIG. 5 and which shows in greater detail the bottom structure of the applicant's novel tray. As before described, the tray 24 is formed with a series of second tubular concaved shaped cavities 59 which support the adjacent tube 28 in the tray below or above. These cavities 59 are formed whenever the upper side of the tray is formed and comprise a triangular shaped cavity 114 and 118 and a centrally positioned diamond shaped cavity 116. These cavity areas are shown speckled in FIG. 12. These cavities are formed by the upwardly extending cavities 46, 47 and 48 on the upper side of the tray as shown on the right side of FIG. 12.

There are also formed on the underside of the tray a pair of supporting rib or platform areas 120 and 122 shown in the speckled area for purposes of clarity. These ribs or platform areas are formed from the upwardly extending X-shaped cavities 50 and 51 on the upper side of the tray. They are also formed by the spanning cavities 61 also formed on the upper side of the tray.

The underside cavities 114, 116 and 118 and ribs or platform surface 120 and 122 contact the surface of the adjacent lamp 28 below and are concaved by diverging downwardly to engage and space apart the underneath lamp and create a space of approximately 0.12 inches thick between adjacent lamps. As will be described hereinafter, it is essential that a proper distribution of plastic material be made into the speckled area supporting the tube 28 so that the plastic will have a controlled deformation with a controlled resilient return from deformation.

It will be noted that five points of contact, shown in the speckled areas, are obtained with two triangular shaped areas 114 and 118 and one diamond shaped area 116 having two cross bands or ribs 120 and 122 formed on either side. All five of these areas are also formed to correspond to the curvature of a standard 1½ inch diameter tube 28 and provide support to the fluorescent tube adjacent to the points of contact.

Figure 13:
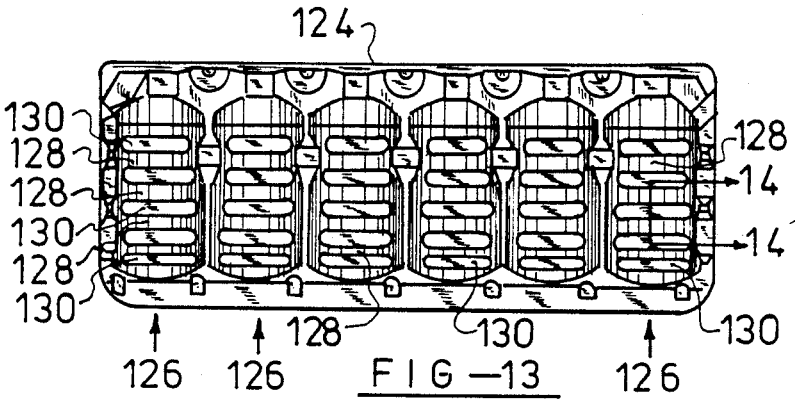
FIG—13 PRIOR ART
FIG. 13 is a top plan view of the prior art supporting tray shown in U.S. Pat. No. 4,705,170.

Referring now to FIGS. 13–19 there will be described in detail the problems encountered with prior art formed plastic trays in general and in particular the Creaden design after which will be discussed the applicant's unique solution to the problem. FIG. 13 is a top plan view of the prior art Creaden tray 124 shown in the U.S. Pat. No. 4,705,170. The tray 124 is formed from polyvinyl chloride (PVC) which has a density of approximately ranging from 1.33 to 1.40 grams per cubic centimeter (g/cc). The material is stiff and rigid when formed and not resilient as such.

Figure 14:
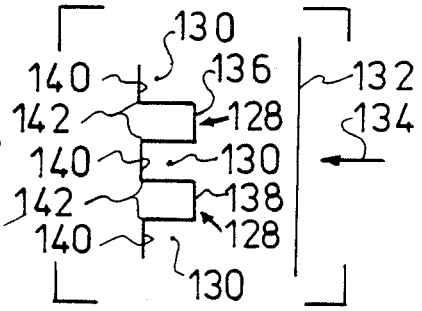
FIG—14 PRIOR ART
FIG. 14 is a single line pictorial representation, taken along lines 14—14 of FIG. 13 showing the typical square wave construction of the prior art supporting tray.

The prior art tray 124 is formed out of this stiff and rigid PVC material into a series of cells shown generally by the numeral 126. Each cell 126 is formed with a series of concaved ribs 128 separated by upward facing cavities 130. FIG. 14 (in brackets) is a single line pictorial representation, taken along lines 14—14 of FIG. 13 and shows the typical construction of the concaved ribs 128. When a sheet 132 of the stiff and rigid PVC is brought into contact with the forming mold as shown by the arrow 134 it "freezes" almost its total starting gauge of 0.014 inches at points 136 and 138. As the sheet 132 is further formed, the bottom of the cavity 130 thins to approximately 0.002 to 0.003 inches at the surface 140. Accordingly the surface 140 is formed with a very thin inverted platform or supporting area which is apparently designed to crush upon strong impact.

It can be seen in FIG. 14 how the prior art tray 124 is designed with a series of parallel supporting platforms on the top and under side. This design is in the configuration of a square wave with sharp corners and parallel side walls. It should also be noted that because of the square wave configuration in combination with the use of a stiff and rigid PVC, the corners 142 of the bottom of the cavity 130 are so thin that they are virtually transparent even though the PVC used is a black or dark color.

The prior art tray 124 does provide a measure of shock protection on the first drop of the package containing the tray with tubes, but its effectiveness is dramatically diminished on subsequent drops. It is believed that the crushed thin supports along the surfaces 140 and at the ends 142 have no ability to rebound or spring back to their original shape. This leaves the package vulnerable to tube breakage on successive impacts. The "controlled crush" feature which has been purposefully designed into the prior art tray 124 requires a material 134 with a high molecular weight such as PVC to form into a square wave shape of the supporting platforms as seen in FIG. 14. The high molecular weight of the PVC is necessary in order to retain any degree of integrity of the material 132 in the very thin crushable areas at 140 and 142.

Figure 15:
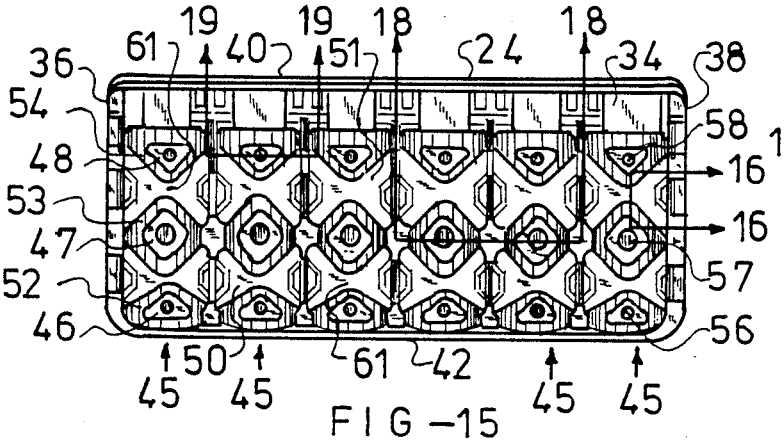
FIG. 15 is a top plan view of the applicant's unique construction, similar to the view shown in FIG. 3 and used for a comparison with the prior art view of FIGS. 13 and 14.
Figure 16:
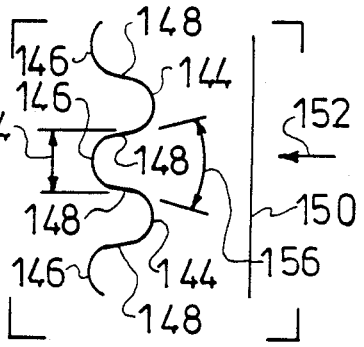
FIG. 16 is a single line pictorial representation, taken along lines 16—16 of FIG. 15, showing the applicant's unique construction using a generally sinusoidal shape having a series of reversing curved configurations forming peaks and valleys in the tray.

Referring now to FIGS. 15 and 16 there will be shown and described in detail the applicant's approach to a tray design that can achieve far superior performance than the prior art design shown in FIGS. 13 and 14. FIG. 15 is a top plan view, similar to the view of FIG. 3 and reduced in size, showing the applicant's novel tray while FIG. 16 is a single line pictorial representation, taken along line 16—16 of FIG. 15. The applicant's unique approach uses the principle of a "controlled deformation with a controlled resilient return" of the deformed areas. This new concept of protection to fragile products, such as fluorescent tubes, provides for the shapes of the supporting ribs, platforms and separating walls to be designed so as to be able to effectively accept a maximum shock and then to spring back to their original form after impact.

In order to accomplish this, the functional design of the tray 24 would include a correct combination of structural configuration and material forming the particular structure. Proper spacing between each supporting formation would be necessary to advantageously distribute the sheet material used substantially equally at the points of contact with the lamp surface. In other words, if a 0.015 gauge sheet material were used, ideally approximately 0.007 inches of material should be left on the peaks of the ribs and conversely approximately 0.007 inches of material should be carried into the valleys of the tray.

To accomplish this, it has been determined that a sheet of material should have a thickness ranging from 0.012 inches to 0.016 inches and should have a less dense quality than PVC. A density ranging from 0.898–0.965 grams per cubic centimeter (g/cc) is believed to be preferable as used in the preferred embodiment. The applicant's first choice of a material is a polyethylene (PE) and not a polyvinyl chloride (PVC) as used in prior art. The polyethylene chosen is a 100% reprocessed material called by the manufacturer as a high density polyethylene (HDPE).

An HDPE material, as supplied by the Alchem Plastic, Inc. of 14263 Gannet Street, La Miranda, Calif. 90638, would be the applicant's first choice and its density ranges between 0.92 and 0.955 grams per cubic centimeter (g/cc). This material has an ultimate tensile elongation of 600% with an elastic modulus in flexure E5 PSI ranges from 1.65 to 2.40. The hardness of the material Shore D ranges from D60 to D67 and it has an impact strength of F50 gms. 2–4.5. These characteristics are calculated ASTM standards.

A second choice for a suitable material would be a high density polypropylene (PP) such as the polypropylene random copolymer known as Fortilene ® 4114. This material has a density ranging between 0.9 and 0.91 grams per cubic centimeter. Its characteristics are somewhat similar in toughness, resilience and impact strength to the preferred choice material. Both of these materials have the necessary resilience to provide the controlled deformation with controlled return desired. Other materials may also be used within the spirit and scope of the invention as long as they can provide the necessary resiliency and properties to accomplish the job.

Coupled with the materials before described, the applicant has designed a new tray supporting structure that does not use the square wave configuration of the prior art shown in FIG. 14. The applicant's unique design is shown in FIG. 16 and comprises using supporting surfaces that are formed in a generally sinusoidal shape as shown. The sinusoidal shape has a series of reversing curved configurations that form the peaks and valleys used for support.

It can be seen in FIG. 16 how the wave-like shape forms peaks 144 and valleys 146 with inclined surfaces 148 formed between the peaks and valleys. By using the configuration shown in FIG. 16, the application of the sheet 150 over the forming mold in the direction shown by the arrow 152 will give the unique configuration shown. By utilizing the angled separation, shown by the arrow 156 between the peaks and valleys and predetermined spacings, shown at 154 between adjacent peaks, an approximate equal distribution of the sheet material is obtainable throughout the form.

Figure 17:
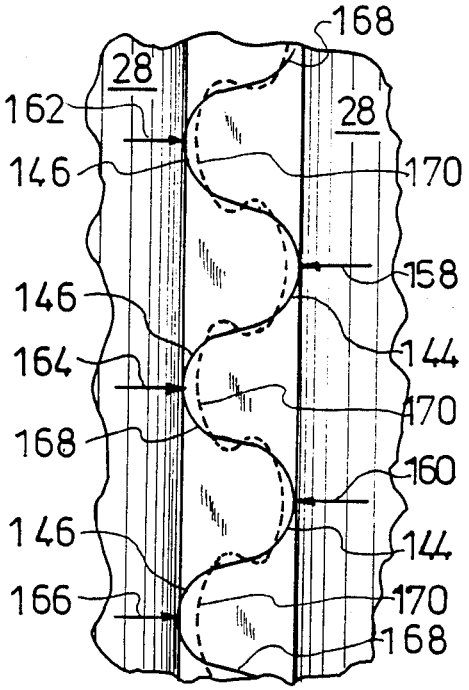
FIG. 17 is an enlarged single line pictorial representation of FIG. 16 and having a pair of fluorescent tubes shown applying a deforming load to the applicant's novel sinusoidal construction and showing in a dashed line how that construction will have a controlled deformation with a controlled resilient return from the deformation when a load shock is applied and removed from the supporting trays.

That is to say, that an 0.015 gauge sheet material 150 would leave approximately 0.007 inches of thickness on the peaks 144 of each rib support and would conversely leave approximately 0.007 inches of material in the valleys 146. Referring now to FIG. 17, there is shown an enlarged single line pictorial representation of FIG. 16. FIG. 17 shows how the equal distribution of the material in the peaks 144 and valleys 146 causes the structure to impact in a manner similar to that of an automobile tire. In FIG. 17, a pair of arrows 158 and 160 would represent the load force on impact from one tube while the opposite arrows 162, 164 and 166 would represent the load force on impact from the adjacent tube 28.

The solid single line 168 would represent the applicant's novel structure prior to impact as formed in a non-stressed condition. The dashed line 170 would represent the same tray at impact having deformed a controlled amount. After impact, the applicant's structure would return to its original shape in the solid line configuration 168. The use of the material HDPE or PP before described would provide the necessary resiliency to assure a controlled resilient return to its prior shape. From this it can be seen how the applicant's unique structure design functions similar to a rubber automobile tire reacting to the impacts of a bumpy road.

Since the entire tray 24 is formed from the particular resilient material specified, it can be seen how the tray functions in other parts of the structure because of its resilience. For example it can now be understood how the four wall separating structure shown in FIGS. 9 and 10 benefit from the resiliency of the selected material to spring back to their original shape and not to collapse as in the prior art. Similarly it can be seen how the trapezoidal shaped areas 65 shown in FIG. 8 benefit from the resilience of the selected material which allows them to spring back and not to be crushed.

In addition, it can now be seen how the side by side cells 45 can function in regard to each other transferring load shock, due to the before described shape, from one cell to the adjacent cell. For example the individual cells 45 are integrally tied one to another for the purpose of dissipating a shock to its neighboring cavity or cell 45. The connecting platforms or notches 100, 102 and 104 are biaxially oriented in each cell 45 and have a fastening point to the next adjoining cavity or cell 45. This connecting point permits some transference of shock between cells. The same is true of the triangular and diamond shaped platform and the material's resilience contributes to the overall performance of the tray as a unit.

Figure 18:
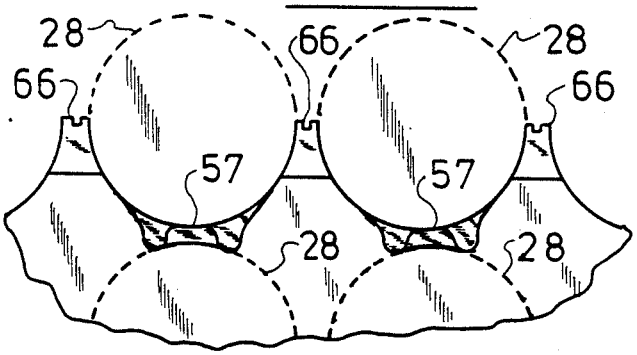
FIG. 18 is a single line cross-sectional view, taken along lines 18—18 of FIG. 15 showing the applicant's novel construction in the center of the supporting tray and showing how that construction is used to support adjacent fluorescent tubes in the tray.
Figure 19:
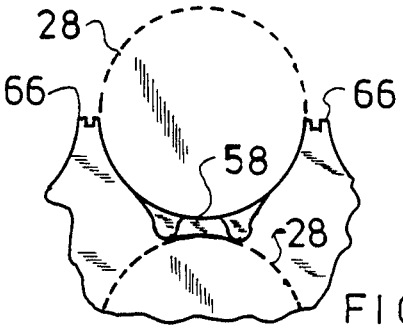
FIG. 19 is another single line cross-sectional view, taken along lines 19—19 of FIG. 15 showing the same novel construction used in the ends of the supporting tray.

FIGS. 18 and 19 show cross-sectional views taken along lines 18—18 and 19—19 of FIG. 15 and further illustrate how the novel sinusoidal configuration shown in FIG. 17 is used throughout the tray in the pertinent supporting areas. FIGS. 18 and 19 are taken transverse to the view taken in FIG. 17 which is longitudinal along the tube axis.

In order to obtain the desired 50%–50% distribution of material between the peaks 144 and valleys 146, the mold surface used to form the tray must be carefully engineered in order to manipulate the resilient thin sheet of HDPE or PP to accomplish the ideal 50%–50% distribution. Careful attention should be given to the shape of the opposite counterpart of the mold known as the assist which physically forces the resilient sheet into desired proximity to the mold surface. In addition, careful attention should be given to the heat application to both the resilient sheet and the mold itself and the mercury inches of vacuum and its timing when doing the molding.

The air pressure application properly timed and proper entry and speed of upper and lower platens are other factors in the molding process that also require careful attention. When a tray is designed and manufactured in accordance with the applicant's unique design herein described, there will be found that the tray functions to prevent tube breakage in a very much improved manner.

For example, comparative drop tests were performed using the prior art tray of the Creaden design shown in FIG. 13 and the applicant's unique tray shown in FIG. 15. These tests were performed, beginning in January of 1989 and were just concluded in May of 1989, under conditions set by the applicant's customer, Philips Lighting Co., in the customer's plant in Salina, Kans. A total of 7,920 four (4) foot fluorescent lamps were dropped in sealed cartons of 30 each making a total of 264 cartons. Each carton was required to fall onto a flat concrete floor on all four sides from a distance of 18 inches.

Documentation is available to support the fact that the applicant's trays performed substantially better than the prior art tray. The applicant's tray required 30%–50% more drops from 18 inches before breakage of tubes occurred. More recent actual series of tests showed a minimum of 50% more drops before breakage occurred. In addition, the customer conducted two of his own tests and is presently performing a third and last test. The customer has stated that both tests using the applicant's tray were "excellent" and that, "they had never had one that good," referring to the prior art tray.

From the foregoing it should be apparent that the applicant's invention is a unique departure from the prior art structures and the test results given conclusively show that. The novel construction coupled with the selection of a resilient sheet material provides for a controlled deformation and a controlled resilient return from the deformation of the various portions of the tray. The floating of portions of the tray in respect to other portions and the transference of shock between cavities all result in achieving a much improved tray that accomplishes all of the objects and advantages of the invention as stated and many more.

It should also be apparent that changes and alterations may be made in the applicant's structure and his design is not to be limited to the exact embodiment shown and described which has been given by way of illustration only.

Having described my invention, I claim:

1. In an elongated tray of the type designed to support a plurality of tubular objects side by side from breaking in transit, and to uniformly distribute stresses occurring in the dropping of a package containing a plurality of trays and tubular objects, the improvement comprising:

(a) a plurality of vertically positioned side by side concaved shaped tubular receiving cavities formed in the tray:

(1) a plurality of tubular supporting surfaces formed in each tubular receiving cavity, the tubular supporting surfaces being formed with a plurality of upper undulation and striation free supporting cavities and a plurality of lower undulation and striation free supporting cavities, the upper supporting cavities and the lower supporting cavities being formed as support ribs underneath the tubular supporting surfaces with the upper and lower undulation and striation free supporting cavities being formed in a generally sinusoidal shape having a series of reversing curved configurations forming peaks and valleys;

(b) the tray being formed of a plastic material having a density ranging between 0.898–0.965 grams per cubic centimeter; and (c) the thickness of the plastic material formed in the peaks and valleys of the upper and lower undulation and striation free supporting cavities being approximately of equal thickness so that the material forming the tray will not collapse upon a single load being applied but will have a controlled deformation with a controlled resilient return from the deformation upon a repeating load shock being applied to and removed from the tubular receiving cavities thereby permitting the tray to continue to function during repeated load shocks without collapsing during a single load shock.

2. The improvement as defined in claim 1 wherein the thickness of the tray is approximately 0.015 inches and the thickness of the material in each peak and valley of the upper and lower supporting cavities is approximately 0.007 inches.

3. The improvement as defined in claim 1 wherein the material forming the tray is a high density polyethylene.

4. The improvement as defined in claim 1 wherein the plastic material forming the tray is a polypropylene random copolymer.

5. The improvement as defined in claim 1 wherein the plurality of tubular supporting surfaces with the plurality of upper and lower supporting cavities being formed independent from each other so as to float during load shock and to provide a staggered resistance to load shock.

6. In an elongated tray of the type designed to a plurality of tubular objects side by side from breaking in transit, and to uniformly distribute stresses occurring in the dropping of a package containing a plurality of trays and tubular objects, the improvement comprising:

(a) a plurality of side by side concaved shaped tubular receiving cavities formed in the tray;

(1) a plurality of tubular supporting surfaces formed in each receiving cavity, the tubular supporting surfaces being formed in a generally sinusoidal shape having a series of reversing curved configurations forming peaks and valleys;

(b) the tray being formed of a plastic material having a density ranging between 0.898 –0.965 grams per cubic centimeter;

(c) the thickness of the plastic material formed in the peaks and valleys being approximately of equal thickness so that the material forming the tray will have a controlled deformation with a controlled resilient return from the deformation upon a load shock being applied to and removed from the tubular receiving cavities; and (d) each side by side concaved shaped receiving cavity h as formed therebetween longitudinal spacer walls for providing separation between adjacent tubular objects, the spacer walls being formed with three adjacent areas forming four thicknesses of plastic material between adjacent tubular objects.

7. The improvement as defined in claim 1 wherein the longitudinal spacer walls between adjacent receiving cavities are formed separated with varying height transfer surfaces to transfer load shock from one cavity to the adjacent cavity.

8. The improvement as defined in claim 7 wherein a portion of the separated adjacent spacer walls is formed with generally trapezoidal shaped indentations situated opposite each other, the indentations being designed to make contact with each other thereby serving as absorption bumper standoffs to absorb horizontal load shock.

9. The improvement as defined in claim 8 wherein a plurality of supporting posts are formed in juxtaposition to the plurality of tubular supporting surfaces to provide further support to the tubular objects and to provide further staggered resistance to load shock.

10. In an elongated tray of the type designed to support a plurality of tubular objects side by side in a plurality of concaved shaped receiving cavities formed in the tray, the tray being designed to uniformly distribute load shock occurring in the dropping of a package containing a plurality of the trays, the improvement comprising:

(a) each receiving cavity being formed with a plurality of tubular shaped supporting platforms having peaks and valleys and being formed independently from each other so as to float during load shock and to provide a staggered resistance to load shock;

(b) each receiving cavity being formed with a plastic material having a controlled deformation with a controlled resilient return upon load shock being applied to and removed from the receiving cavity;

(1) the plastic material having a density ranging between 0.898–0.965 grams per cubic centimeter;

(2) the plastic material being formed approximately of equal thickness in the peaks and valleys of the supporting platforms in order to obtain the controlled deformation with a controlled resilient return; and (c) the adjacent receiving cavities having formed therebetween a plurality of longitudinal spacer walls having a four wall thickness with adjacent air spaces to provide improved cushioning between adjacent receiving cavities.

11. The improvement as defined in claim 10 wherein each of the longitudinal spacer walls is formed in three separated sections with varying height transfer surfaces to transfer load shock from one receiving cavity to the adjacent receiving cavity.

12. In an elongated plastic tray designed to support fluorescent tubes positioned in tube receiving cavities having adjacent tube protecting walls, the improvement comprising:

(a) the tube protecting walls being formed with at least four thicknesses of plastic material;

(b) the four thicknesses of plastic material being spaced apart from each other by at least three adjacent areas to provide protective separation against edge drop on horizontal impact; and (c) the plastic tray being formed of a material having a density ranging between 0.898–0.965 grams per cubic centimeter.

13. The improvement as defined in claim 12 wherein the plastic tray is formed of a high density polyethylene.

14. The improvement as defined in claim 12 wherein the plastic tray is formed of a polypropylene random copolymer.

15. An elongated tray for supporting a plurality of elongated tubular objects side by side, comprising:

(a) an integral body formed from synthetic resin sheet material having a thickness prior to forming from about 0.012 to 0.016 inch, the body being formed with spaced apart side panels and a high end panel and further being formed with a low end panel spaced apart from the high end panel, the low end panel receiving an end of the tubular objects therein;

(b) a first plurality of tubular concaved shaped receiving cavities forming the one side of the tray and being formed integrally with the side panels and the end panels;

(1) each first tubular receiving cavity comprising a plurality of upwardly opening longitudinal cavities;

a plurality of upwardly opening transverse cavities, in juxtaposition to the longitudinal cavities;

the upwardly opening longitudinal and transverse cavities being separated by a plurality of generally V-shaped downwardly opening cavities, the V-shaped cavities forming a generally upwardly extending elliptical spaced ridge to provide support for the tubular object.

(c) each upwardly opening longitudinal cavity having formed therein a downwardly opening centrally positioned cavity forming a further support for the tubular object;

(d) a second plurality of tubular concaved shaped receiving cavities forming the other side of the tray, the second plurality of tubular shaped cavities being formed out of the first tubular shaped receiving cavities and being designed to receive an adjacent tubular object whenever a plurality of elongated trays are stacked on top of each other;

(e) a plurality of longitudinal spacer walls integrally formed on each side of the first tubular receiving cavities for providing separation between adjacent tubular objects and for providing still further support to the tubular objects; and (f) spacer means to prevent complete nesting of similar trays when stacked on top of each other, the spacer means serving to provide horizontal space between adjacent nested trays so that the trays can be dispensed from automatic equipment.

16. The elongated tray as defined in claim 15 wherein the number of upwardly opening longitudinal cavities in each tubular receiving cavity is three.

17. The elongated tray as defined in claim 15 wherein the number of upwardly opening transverse cavities in each tubular receiving cavity is four.

18. The elongated tray as defined in claim 17 wherein each adjacent two transverse cavities is joined by a spanning cavity.

19. The elongated tray as defined in claim 15 wherein the downwardly opening centrally positioned cavity formed in each upwardly opening longitudinal cavity is formed in a generally cylindrical shape.

20. The elongated tray as defined in claim 15 wherein the number of second plurality of tubular concaved shaped receiving cavities formed on the other side of the tray is five for each of the first tubular concaved shaped receiving cavities formed on the one side of the tray.

21. The elongated tray as defined in claim 18 wherein two of the second tubular concaved shaped receiving cavities are formed from the spanning cavities.

22. The elongated tray as defined in claim 20 wherein three of the second tubular concaved shaped receiving cavities are formed from the downwardly opening centrally positioned cavity.

23. The elongated tray as defined in claim 15 wherein each of the plurality of longitudinal spacer walls is formed in three spaced apart wall sections.

24. The elongated tray as defined in claim 23 wherein each of the three spaced apart wall sections is formed with two thicknesses of sheet material.

25. The elongated tray as defined in claim 24 wherein adjacent wall sections of the first tubular receiving cavities are integrally formed in a spaced apart relationship to thereby form four thicknesses of sheet material between adjacent tubular objects positioned in the elongated tray.

26. The elongated tray as defined in claim 15 wherein the spacer means comprises a plurality of de-nesting lugs formed in portions of the high end panel and in portions of the longitudinal spacer walls.

27. The elongated tray as defined in claim 26 wherein the de-nesting lugs are formed in the same location on all nested trays so that collation is not required on the trays as is common in prior art type trays.

* * * * *